US008375968B2

(12) United States Patent
Whybrew et al.

(10) Patent No.: US 8,375,968 B2
(45) Date of Patent: Feb. 19, 2013

(54) RETRACTABLE SPORTSMAN'S BLIND

(76) Inventors: Larry O. Whybrew, Liberty Lake, WA (US); Howard W. Whybrew, Liberty Lake, WA (US)

( * ) Notice: Subject to any disclaimer, the term of this patent is extended or adjusted under 35 U.S.C. 154(b) by 103 days.

(21) Appl. No.: 12/807,993

(22) Filed: Sep. 20, 2010

(65) Prior Publication Data

US 2012/0067387 A1 Mar. 22, 2012

(51) Int. Cl.
*E04H 15/02* (2006.01)
*B63C 9/08* (2006.01)

(52) U.S. Cl. ..... 135/96; 135/133; 135/137; 135/901; 441/132; 114/345

(58) Field of Classification Search ..... 135/96, 135/124, 132–133, 137, 115, 116, 119, 901; 114/351, 354, 345, 361, 264; 43/1; 441/129–132
See application file for complete search history.

(56) References Cited

U.S. PATENT DOCUMENTS

| | | | | |
|---|---|---|---|---|
| 549,923 | A | 11/1895 | Layman | |
| 2,327,169 | A | 8/1943 | Bucknell | |
| 2,689,579 | A * | 9/1954 | Sartori | 135/133 |
| 2,816,297 | A * | 12/1957 | Stanley | 114/351 |
| 2,891,260 | A * | 6/1959 | Wright | 114/345 |
| 3,190,300 | A * | 6/1965 | Wear'n | 135/126 |
| 3,704,472 | A | 12/1972 | Huey, Jr. | |
| 3,936,969 | A | 2/1976 | Richard | |
| 4,106,145 | A * | 8/1978 | Gillen et al. | 114/351 |
| 4,671,203 | A * | 6/1987 | Sanburg | 114/361 |
| 5,171,178 | A | 12/1992 | Creek et al. | |
| 5,217,400 | A | 6/1993 | Creek et al. | |
| 5,643,031 | A | 7/1997 | Fenton et al. | |
| 5,690,134 | A * | 11/1997 | McCauley | 135/133 |
| 5,711,743 | A * | 1/1998 | Nichols et al. | 482/27 |
| 5,718,612 | A | 2/1998 | Elsholz | |
| 6,749,475 | B2 | 6/2004 | Howerton | |
| 6,929,521 | B2 | 8/2005 | Howerton | |
| 7,118,173 | B2 * | 10/2006 | Kassai et al. | 297/184.13 |
| 7,314,399 | B2 * | 1/2008 | Turner | 441/129 |
| 2007/0095377 | A1 * | 5/2007 | Poulson | 135/124 |
| 2008/0066794 | A1 | 3/2008 | Durfee | |
| 2009/0100736 | A1 | 4/2009 | Bunce et al. | |

FOREIGN PATENT DOCUMENTS

GB 2222555 A * 3/1990

* cited by examiner

*Primary Examiner* — Winnie Yip
(74) *Attorney, Agent, or Firm* — William A. Jeckle

(57) ABSTRACT

A manually retractable sportsman's blind releasably attached to a support provides a flexible camouflaged body having a mesh fabric window and supported on a frame comprised of plural elongate flexibly resilient stays pivotally attached to one another at proximate end portions to support the flexible camouflaged body and mesh fabric window in a hemispherical shape.

9 Claims, 6 Drawing Sheets

RETRACTABLE SPORTSMAN'S BLIND

BACKGROUND OF INVENTION

Related Applications

There are no patent applications related hereto previously filed in the United States or in any foreign country.

Field of Invention

This invention relates to hunting and fishing equipment, and more particularly to a retractable sportsman's blind for hunting and wildlife observing activities.

Background and Description of Prior Art

The use of blinds while engaging in hunting and wildlife observing activities has been known for ages. The purpose of a blind is multi-fold; first, to conceal the occupant from animals so that the sought after animal will engage in normal activities such as feeding and resting rather than fleeing; and second, to blend into the environmental setting so that the blind itself does not "stand out" as an environmental "oddity" that animals shy away from.

Blinds may be as simple as visual breaks constructed solely of materials located and gathered onsite and arranged as necessary to conceal a user. Blinds may also be comprised of materials that are brought to a desired location by the user and enhanced with materials located onsite such as stakes pounded vertically into the ground to support mesh-like netting thereon into which reeds, cat-tails, vines, branches and the like are woven. Finally, blinds may be complete structures that are transported to the desired location such as popular Final-Approach® blinds used in field hunting.

A blind's ability to blend into the environment is as important as the blind's ability to conceal an occupant because animals tend to shy away from structures that are unusual and do not blend into the surroundings. For instance a large rectilinear wall-blind may function effectively if it is positioned proximate a tree-line or brush-line, but the same rectilinear wall-blind would likely not be effective sitting in the open, near a water line of a pond, or in an open field. It is essential that the blind "blend into" the environment in which the blind is being used.

To this end, various prior blinds have attempted to decrease noticeability by covering the blinds with items such as grass, cat-tails, reeds and the like that "break up" the outline. Other known blinds are covered with materials imprinted with photographic images of the surrounding area in an effort to make the blind indistinguishable from the surroundings. Such photograph covered blinds are however, expensive and use is limited to specific locations where the photographs were taken, and the seasons during which the photographs were taken. For instance, a blind covered in a photographed snow pattern is not likely to be useful when there is no snow cover. Therefore, use of generalized camouflaged patterns is more prevalent as it increases the versatility of the blind by allowing movement from location to location and use from season to season.

Examples of blinds designed to blend into the environmental setting include hollowed-out hay bale blinds that are used in field hunting where hay bales are present, and boat-type skiffs that are molded with wave patterns on an upper surface. As noted previously, blinds may also be inter-woven with vegetation such as cat-tails, branches, vines, roots and the like to break-up straight lines/edges and to make the blind less distinguishable from the environment in which the blind is being used.

However, known blinds have not satisfied the needs of sportsmen who hunt and observe wildlife in rice paddies, marshes and other bodies of shallow water. Boats are not practical for use in rice paddies, marshes and other bodies of shallow water because large floating objects are environmental anomalies that cause animals and water-fowl to shy away, and such bodies of water are frequently filled with debris, stumps, rocks and other hazards that are not conducive to operation of a boat. Hollowed-out hay bales cannot be used effectively in rice paddies, marshes and the like because they too are environmental anomalies. To complicate the matter further, the blinds used in these areas must float as well as blend into the environment.

One naturally occurring structure that is common in rice paddies, swamps, marshes, bodies of shallow water, and other flooded areas where hunting and wildlife observing activities occur is the muskrat hut. Muskrat huts typically have a hemispherical shape and are commonly covered in sticks, branches and grasses.

Most birds and game species have keen vision and are known for shying away from movements that might reveal the presence of a human including a hunter or observer turning his head to visualize approaching animals. For that reason a blind must allow a hunter or wildlife observer to conceal himself within the blind while visualizing the approach of animals, and allow the occupant to quickly retract the blind while having sufficient time to fire his gun to harvest, or photograph, the sought after animal. Furthermore, the retraction of the blind must not dramatically interfere with the hunter's or occupants' visual tracking of the animal prior to the retraction of the blind. If this were not the case, the blind's occupant might lose visual contact of the animal and therefore miss the opportunity to shoot or photograph the animal.

A variety of sportsman's blinds having open tops that need not be retracted, as well as blinds having automatic opening and closing mechanisms are known. Unfortunately, open-top blinds do not conceal occupants from birds flying overhead and automatic opening and closing blinds have mechanical mechanisms that make them heavy, bulky, and difficult to transport to a desired location. This is a significant drawback when using the blind in flooded fields, marshes, rice paddies and the like where heavy equipment must be manually carried to the site and footing may be precarious. Further, mechanical mechanisms are prone to failure, especially in adverse weather conditions which are common in late fall and winter hunting seasons when cold and wet weather is the norm.

What is needed is a sportsman's blind that blends into the environmental surroundings of rice paddies, marshes, wetlands, bodies of shallow water, and similar areas. The blind must conceal the occupant from visualization by the sought after animal from all angles of approach, including directly overhead, while simultaneously maintaining the occupant's ability to visualize the animal, the approach of the animal and any fleeing the animal might do. The blind must be lightweight, easy to transport, and provide some level of protection from the elements to the user.

The blind must be economical to produce and provide sufficient flexibility and structural integrity to provide the functions for which it is intended. Further, the blind should be supported by a variety of structures including, but not limited to, float tubes, skiffs, legs, the ground and the like.

Our invention overcomes various drawbacks of known sportsman's blinds by providing a blind that blends into the environment in which it is used, camouflages the occupant from visualization from all angles of approach including directly overhead while allowing the occupant to visualize the sought after game species during flight and during approach, is lightweight and easy to transport, and is simply and quickly retractable to allow a user to shoot at the animal or photograph the animal.

Our blind provides a frame that is releasably attached to a floating structure to support a flexible camouflaged body thereover to mimic a muskrat hut. A portion of the flexible camouflaged body is formed of a mesh fabric window to allow the occupant to visualize the sought after animal. Plural elongate flexible stays form the frame and are pivotally interconnected to one another at proximate end portions to support the flexible camouflaged body in a hemispherical shape. The pivotal interconnection of the stays allows the blind to be quickly and easily retracted to permit the occupant to fire at or photograph the animal.

Our invention does not reside in any one of the identified features individually, but rather in the synergistic combination of all of its structures, which give rise to the functions necessarily flowing therefrom as hereinafter specified and claimed.

SUMMARY

A retractable blind for releasable attachment to a support generally provides a flexible camouflaged body having a mesh fabric window supported on a frame comprised of plural elongate flexibly resilient stays pivotally attached to one another at proximate end portions to support the flexible camouflaged body in a hemispherical shape resembling a muskrat hut.

In providing such an apparatus it is:

a principal object to provide a blind that blends into the environmental setting in which it is used.

a further object to provide a blind that conceals an occupant from all angles of approach while preserving the occupant's ability to visualize animals.

a further object to provide a blind that is retractable.

a further object to provide a blind that is light weight and transportable.

a further object to provide a blind that is releasably attachable to a variety of support structures.

a further object to provide a blind that may be positioned over a pit.

a further object to provide a blind that is camouflaged.

a further object to provide a blind having a mesh fabric window.

a still further object to provide a blind that is releasably attachable to a floating support such as a float tube.

Other and further objects of our invention will appear from the following specification and accompanying drawings which form a part hereof. In carrying out the objects of our invention it is to be understood that its structures and features are susceptible to change in design and arrangement with only one preferred and practical embodiment of the best known mode being illustrated in the accompanying drawings and specified as is required.

BRIEF DESCRIPTIONS OF DRAWINGS

In the accompanying drawings which form a part hereof and wherein like numbers refer to similar parts throughout:

DESCRIPTION OF PREFERRED EMBODIMENT

Figure 1:
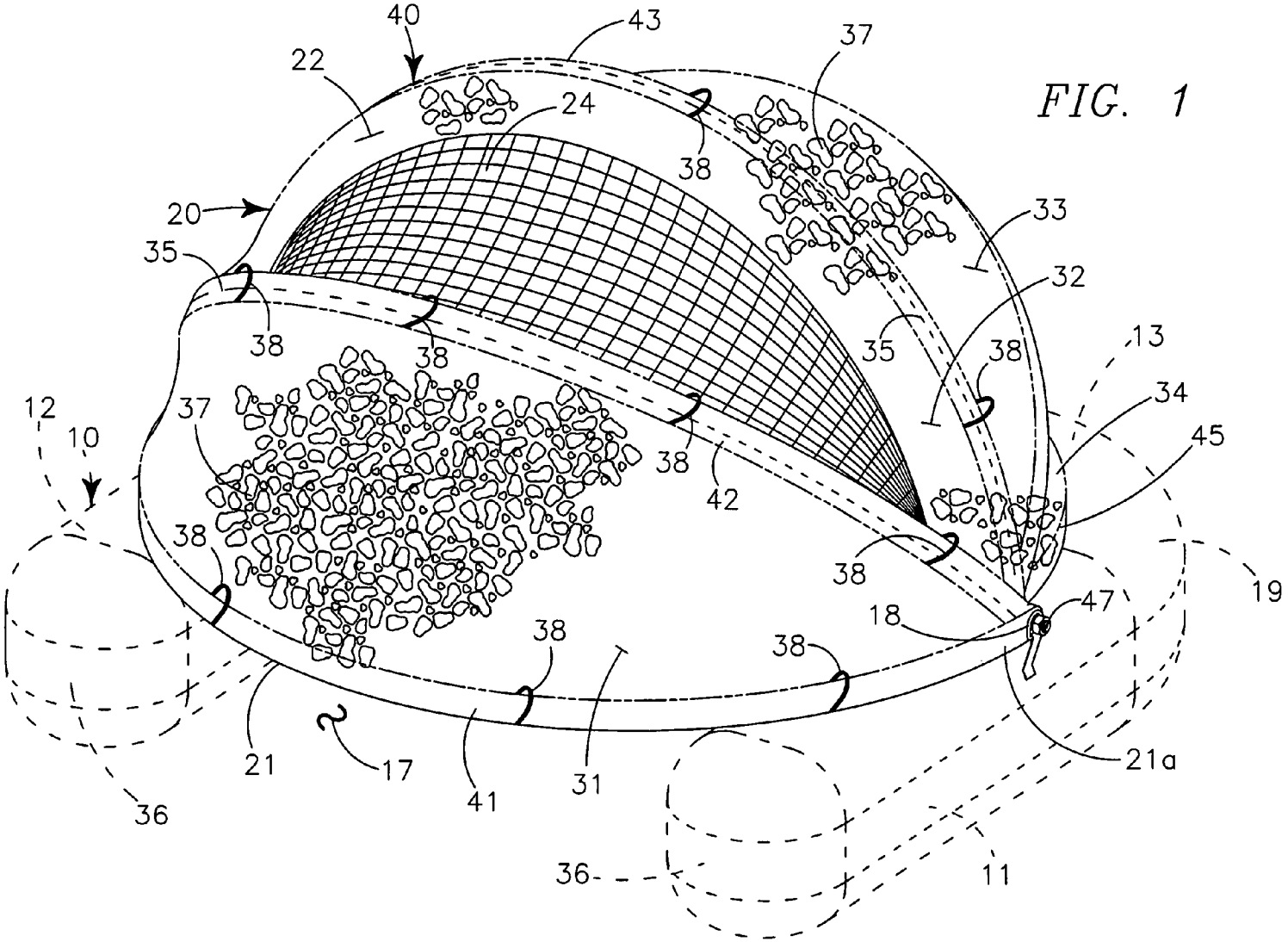
FIG. 1 is an isometric front, top and left side view of our blind in an extended occupant concealment configuration showing a sample of a "blotch-type" camouflage pattern on the flexible camouflaged body, the flexible camouflaged body and frame supported on a float tube shown in dashed outline.
Figure 2:
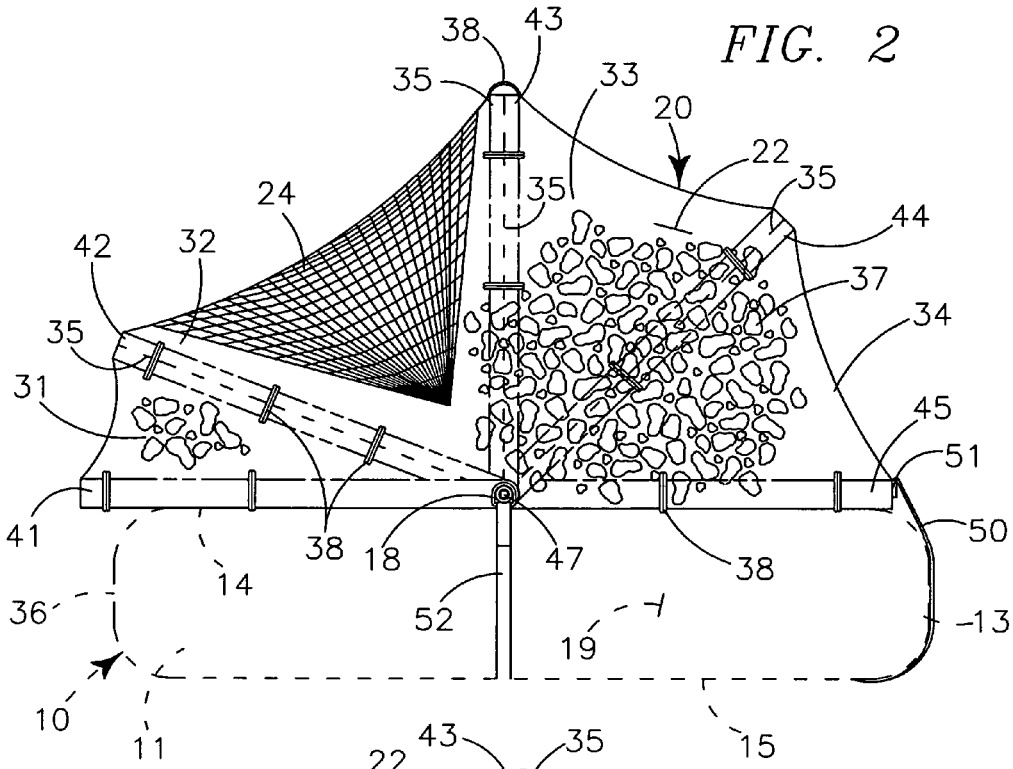
FIG. 2 is an orthographic left side view of the blind of FIG. 1.
Figure 3:
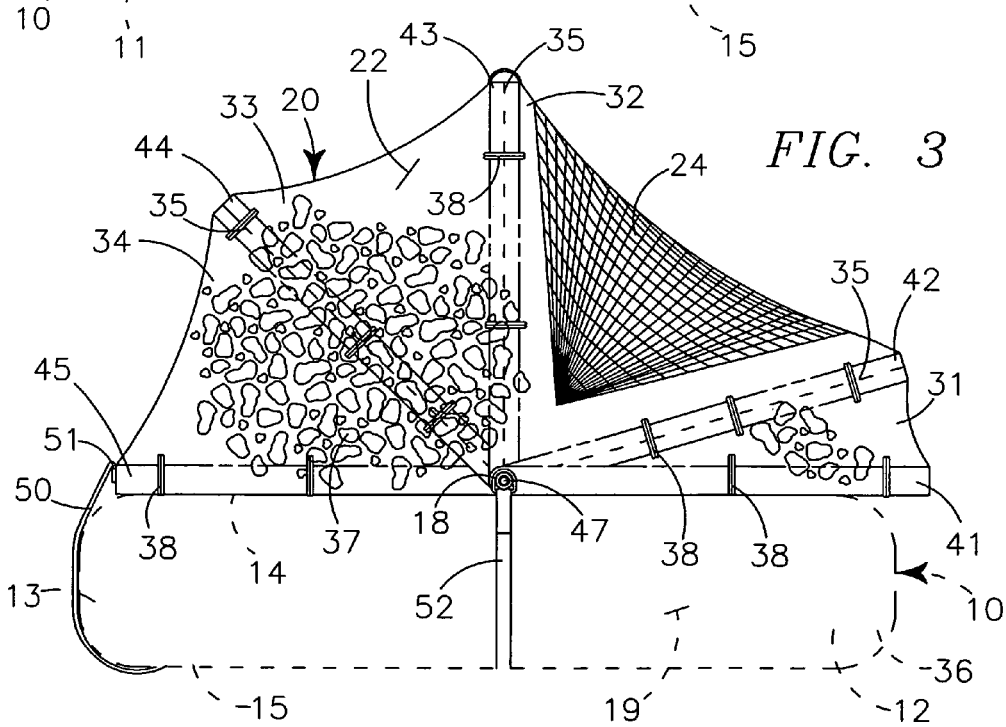
FIG. 3 is an orthographic right side view of the blind of FIG. 1.

As used herein, the term "water-fowl" is not limited to ducks and geese and the like, but is intended to be inclusive of all game animals including species other than birds that may be sought for food, sport, photography, research and the like with the use of blinds. The term "inner", its derivatives, and grammatical equivalents refers to that portion of our blind that is proximate a positional center of the blind. The term "outer", its derivatives, and grammatical equivalents refers to that portion of the blind that is distal from the positional center. The term "lower", its derivatives, and grammatical equivalents refers to that portion of the blind that is proximate a supporting surface. The term "upper" its derivatives and grammatical equivalents refers to that portion of the blind that is distal from the supporting surface.

Our sportsman's blind generally provides a flexible body 20 supported by a frame 40 formed of plural elongate flexibly resilient stays 41, 42, 43, 44, 45 pivotally interconnected with one another at proximate end portions to support the flexible body 20 in a hemispherical shape over a support structure such as, but not limited to, a float tube 10.

Flexible body 20 is preferably formed of fabric material that is waterproof, weather resistant and imprinted with a camouflage pattern 37 at least on first outer surface 22 and preferably on both the first outer surface 22 and second inner surface 23. The camouflage pattern 37 is formed by known means and may be formed of dyed splotches of green and brown and black and tan, or other colors, to make the blind difficult to distinguish from the surrounding environment. Typically, the shapes and splotches are somewhat general in nature and do not replicate any particular environment although the pattern of shapes and splotches may generically represent foliage, sticks, branches, grass, cat-tails, moss and the like. The body 20 is of a color that blends into the environmental surroundings in which the blind is used. A generalized "blotch pattern" camouflage is shown in the Figures as an example, but other patterns may be used as well and are contemplated herein.

Sections 31, 32, 33, 34 form the flexible body 20 and each section 31, 32, 33, 34 individually has the shape of a sector. Adjacent edge portions of adjacent sections 31, 32, 33, 34 are fastened together with stitching 35 so that the sections 31, 32, 33, 34 may be supported by the frame 40 in a hemispherical shape having a first outer surface 22, a second interior surface 23 and a circumferential edge 21 extending thereabout.

Mesh fabric window 24 is carried by the flexible body 20, over an opening (not shown) preferably defined in the second section 32, and is fastened to the second section 32 with stitching (not shown) extending through edge portions of the mesh fabric window 24 and through the second section 32 spacedly adjacent peripheral edge of the opening (not shown). The mesh fabric window 24 is preferably formed of a flexible mesh-type material having a weave that is less dense than the weave of the fabric material forming the flexible body 20. The material of the mesh fabric window 24 allows an occupant within the blind may see outwardly therethrough, but observers, including animals, outside the blind cannot see into the blind or distinguish human activity inside the blind. The "one-way" vision characteristic of the mesh fabric window 24 results from, among other things, light differential between the exterior of the blind and the interior of the blind. Sections 31, 32, 33, 34 of the body 20 are formed of a material that is not as translucent, or light permeable as the mesh fabric window 24 and therefore the interior of the blind is darker and less illuminated than the exterior of the blind. This light differential facilitates vision of an occupant through the mesh fabric window 24 from the inside to the outside, but inhibits vision from the outside to the inside of the blind through the mesh fabric window 24. In the preferred embodiment, the mesh fabric window 24 is formed polyester porthole mesh.

The mesh fabric window 24 also has a shape similar to a sector so that when the mesh fabric window 24 is fastened to the second section 32 of the flexible body 20, and the blind is extended to a first occupant concealing position (FIG. 4) the mesh fabric window 24 is stretched into a shape similar to that of the spacedly adjacent first section 31 of the body 20 and the spacedly adjacent third section 33 of the body 20.

Figure 4:
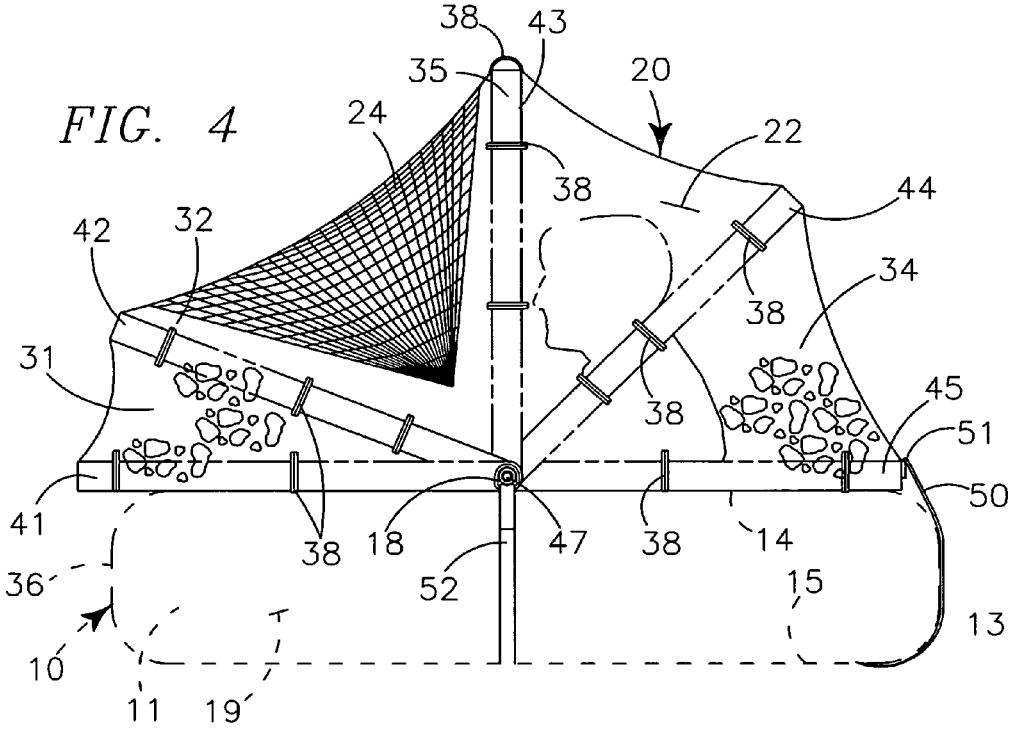
FIG. 4 is an orthographic left side view similar to FIG. 2, showing a concealed occupant, in phantom outline, within the blind.
Figure 5:
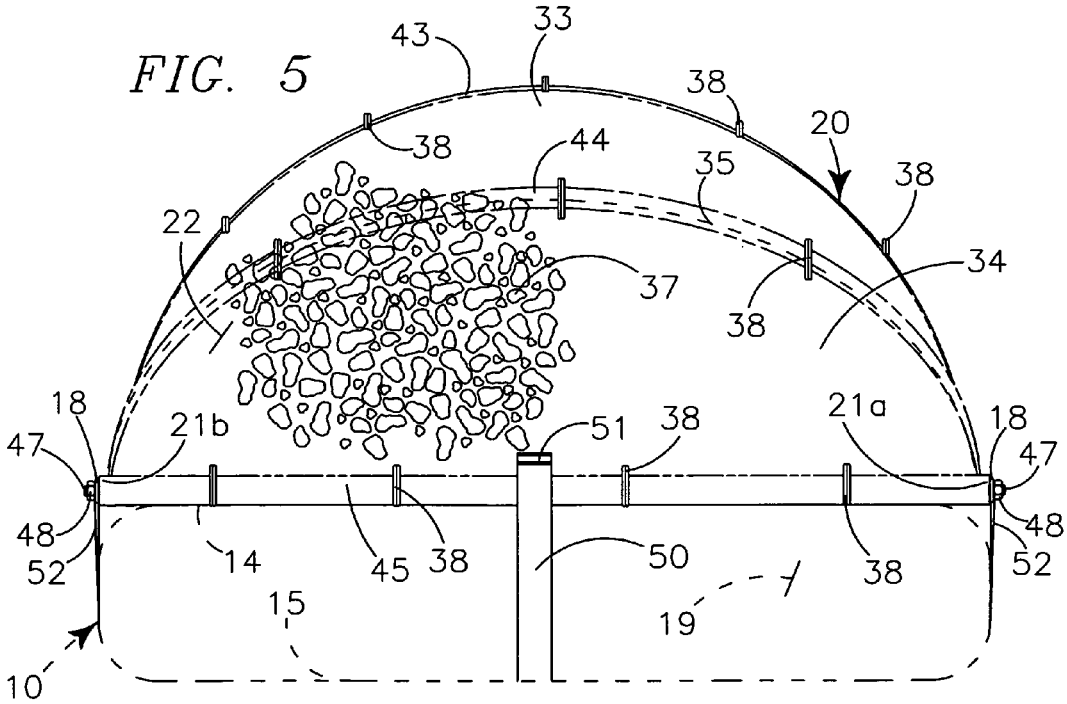
FIG. 5 is an orthographic rear view of the blind of FIG. 1.
Figure 6:
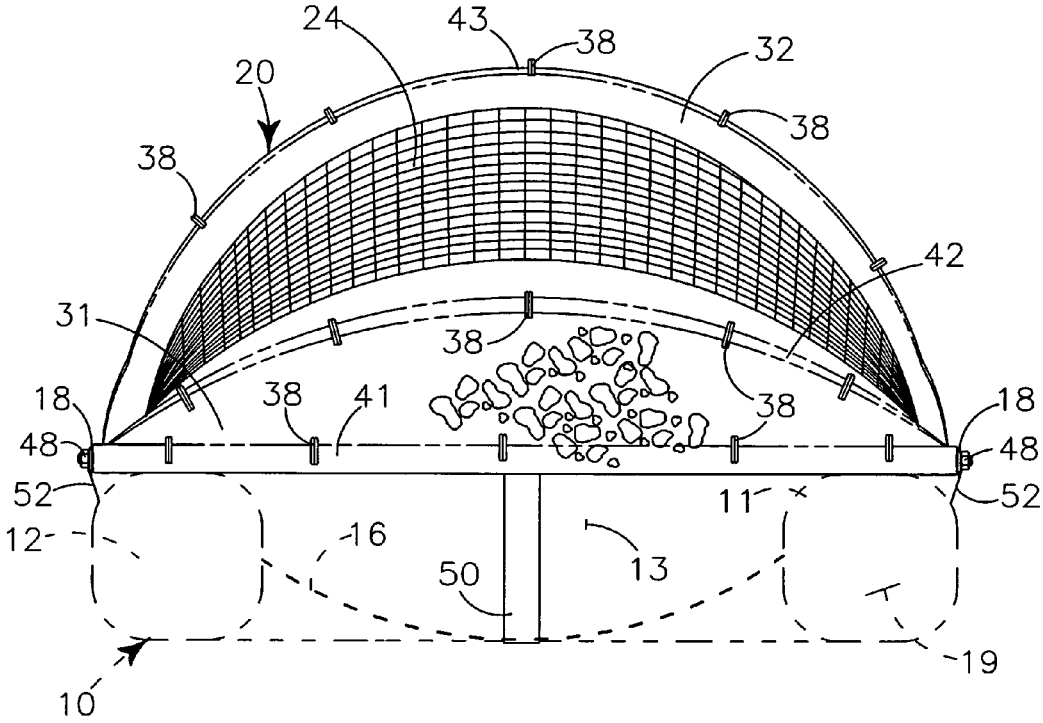
FIG. 6 is an orthographic front view of the blind of FIG. 1.
Figure 10:
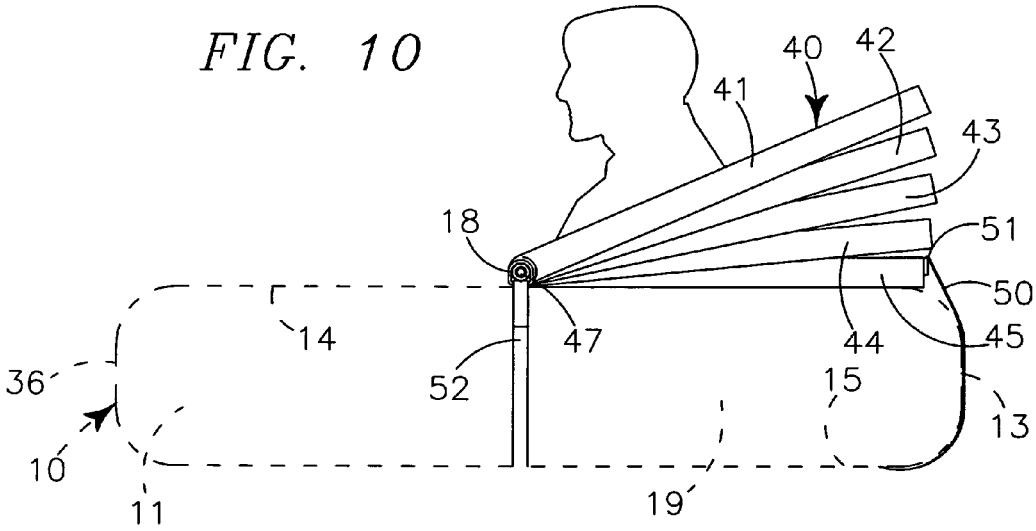
FIG. 10 is an orthographic left side view similar to FIG. 4 showing the frame retracted rearwardly to an occupant exposed position less the flexible camouflaged body on the frame.
Figure 7:
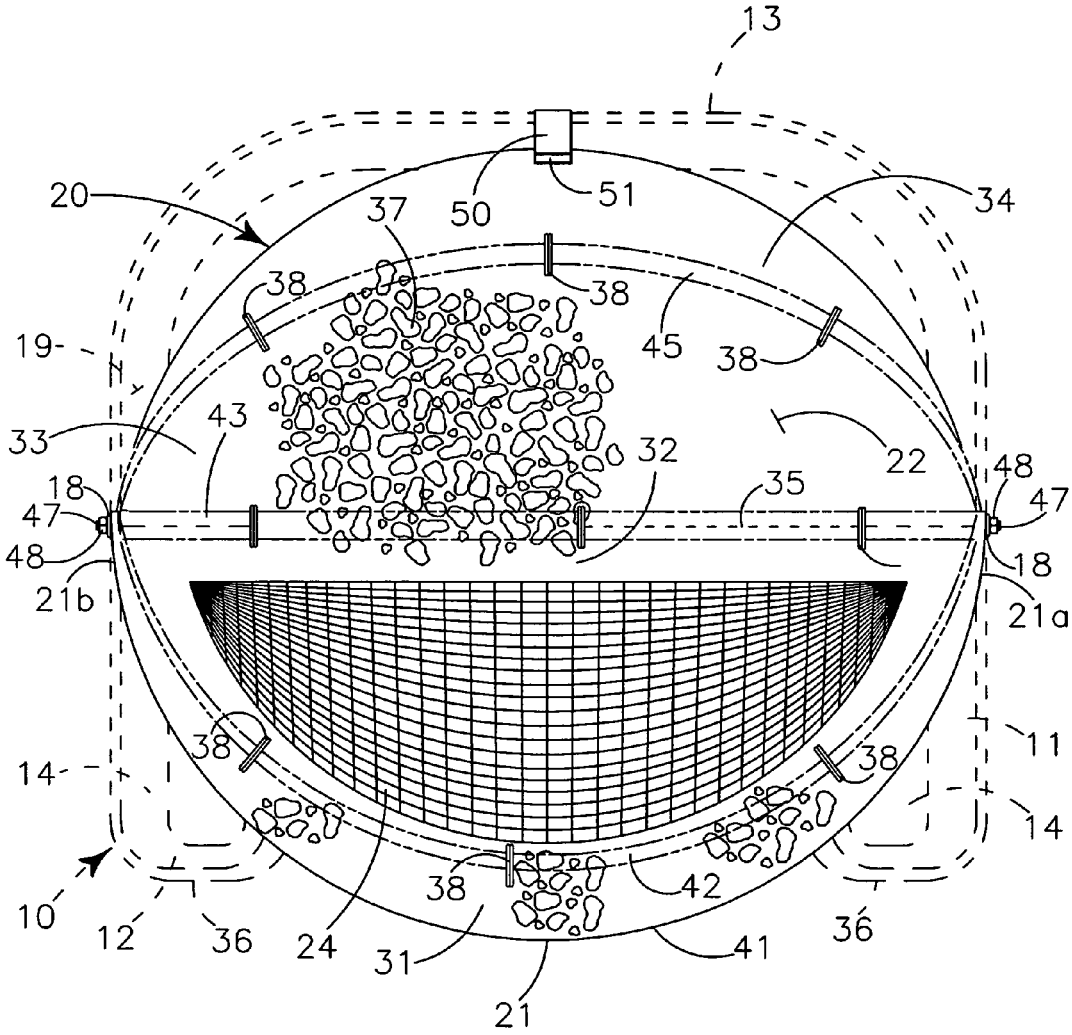
FIG. 7 is an orthographic plan view of the blind of FIG. 1.

The waterproof quality of the material of the body sections 31, 32, 33, 34 allows an occupant inside the blind to remain relatively dry, when the blind is used in rainy conditions, by moving rearwardly inside the blind so that the third section 33 is vertically over the occupant's head. (FIG. 4). Further, because game birds typically land "into the wind", an occupant can position the blind so that the mesh fabric window 24 faces "down wind" which will maintain visibility of approaching game birds, while sheltering the occupant from the wind which will strike and be deflected by the fourth section 34 and third section 33 of the body 20 which is behind the occupant.

Foliage loops 38 are spacedly arrayed about the body 20 on the first outer surface 22 to provide a means to temporarily attach "bunches" of grass, cat-tails, foliage and the like to the first outside surface 22 of the body 20 to further enhance the camouflaging of the blind and to "break up" the outline of the blind. The foliage loops 38 are preferably formed of loops of elastomeric material through which the foliage may be inserted, or strips of opposing sections of hook and loop type fastener (not shown) that may be fastened about "bunches" of foliage. The foliage loops are preferably located proximate the seams of the sections 31, 32, 33, 34 and are oriented relative to the body 20 so that bunches of grass, foliage and the like inserted through the foliage loops 38 extend generally parallel to the seams of the sections 31, 32, 33, 34 so that the bunches of grass, foliage and the like do not interfere with the retraction of the blind.

Figure 9:
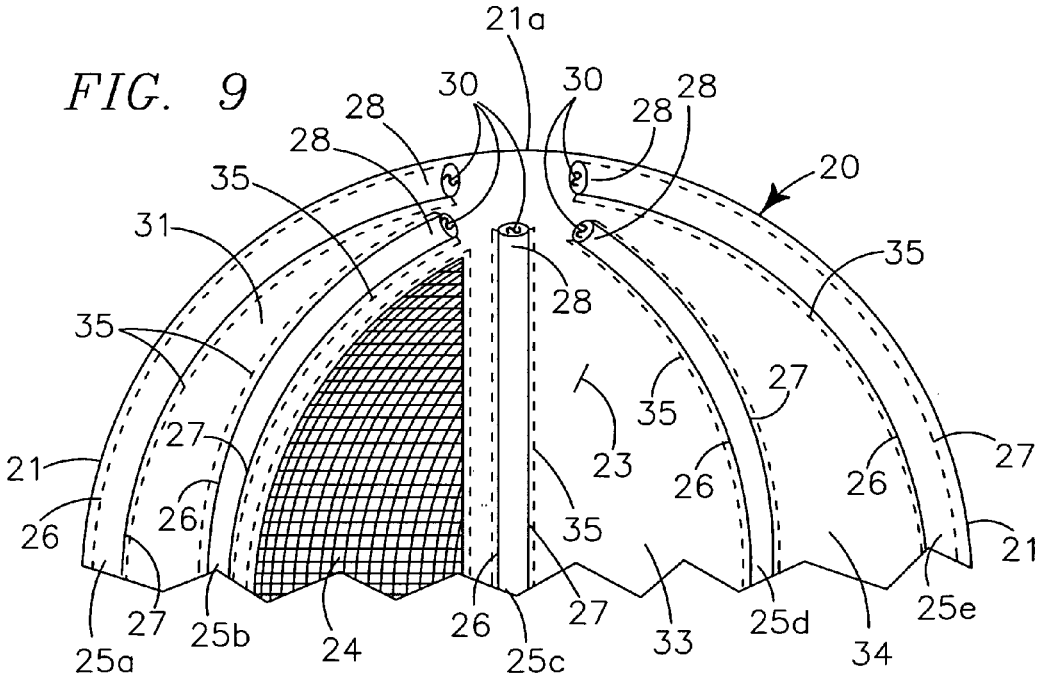
FIG. 9 is a partial cut-away artist's rendition of interior surface of the flexible camouflaged body showing the stay envelopes stitched thereto.

As shown in FIG. 9, plural stay envelopes 25*a*, 25*b*, 25*c*, 25*d*, 25*e* are spacedly arrayed about the second inner surface 23 of the flexible body 20 and are secured thereto with stitching 35. Each stay envelope 25*a*, 25*b*, 25*c*, 25*d*, 25*e* has a first edge 26 and a spacedly adjacent second edge 27 and defines a medial channel 30 therebetween extending from first end portion 28 proximate first circumferential edge portion 21*a*, to a second end portion (not shown) proximate a diametrically opposite second circumferential edge portion 21*b*. The stay envelopes 25 are preferably positioned proximate the stitched 35 seams between the adjacent sections 31, 32, 33, 34.

Figure 8:
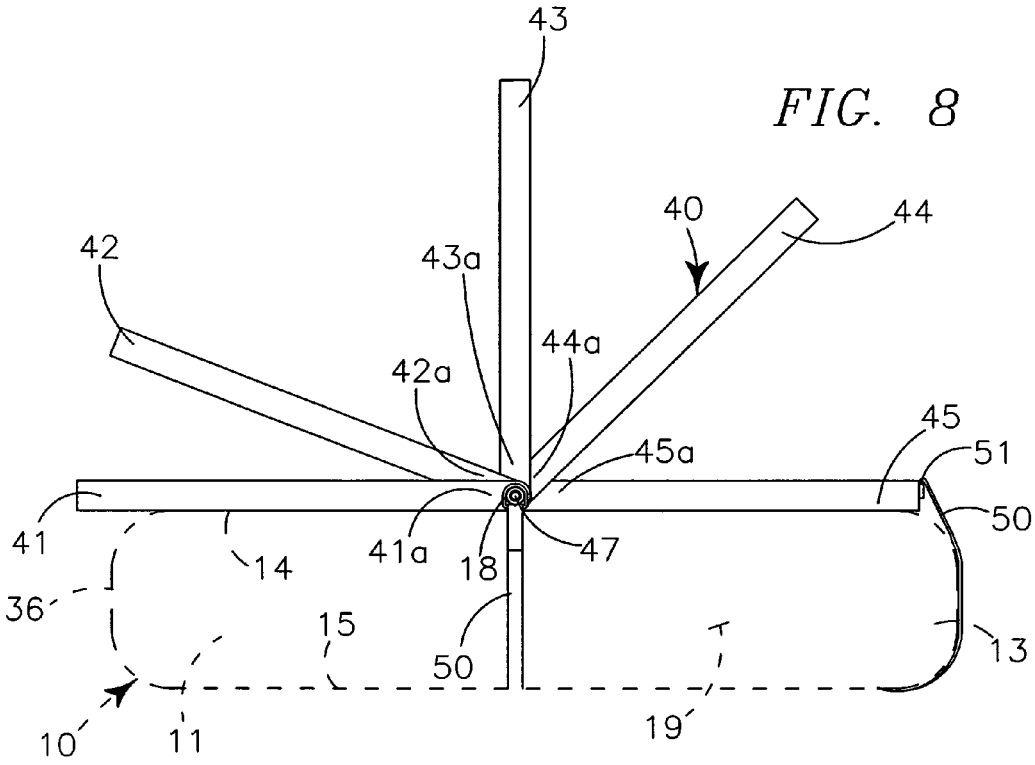
FIG. 8 is an orthographic left side view of the blind of FIG. 1 with the flexible camouflaged body removed from the frame.

The frame 40 supports the camouflaged flexible body 20 in a generally hemispherical shape thereover. As shown in FIG. 8, the frame 40 has a first stay 41, a second stay 42, a third stay 43, a fourth stay 44 and a fifth stay 45. Each stay 41, 42, 43, 44, 45 is elongate and flexibly resilient and in the preferred embodiment is formed of fiberglass although it is anticipated that other natural and synthetic materials that are flexibly resilient, such as but not limited to, bamboo, metal, carbon fiber, plastic, lexan, polycarbonate and the like may likewise be used. Each stay 41, 42, 43, 44, 45 has a first end portion 41*a*, 42*a*, 43*a*, 44*a*, 45*a* and an opposing second end portion (not shown). An axle hole (not shown) is defined in each end portion of each stay 41, 42, 43, 44, 45 to carry a pivot axle bolt 47 extending therethrough which is secured in the axle hole (not shown) with a pivot axle nut 48 and washer (not shown). In the preferred embodiment the stays 41, 42, 43, 44, 45 are slat-like and the axle hole (not shown) is defined directly therein. If the stays 41, 42, 43, 44, 45 are rod-like in configuration (not shown) a bracket (not shown) defining the axle hole (not shown) may be fastened to each end of each stay 41, 42, 43, 44, 45 to carry the pivot axle bolt 47 and provide the pivotal interconnection.

First stay 41 is carried in medial channel 30 of stay envelope 25*a* (FIG. 9) that extends about circumferential edge portion 21 of the flexible body 20 proximate the mesh fabric window 24. Fifth stay 45 is carried in the medial channel 30 of stay envelope 25*e* that extends about the circumferential edge 21 of the flexible body 20 diametrically opposite the first stay 41. The second stay 42, third stay 43 and fourth stay 44 are similarly carried in the medial channel 30 of stay envelopes 25*b*, 25*c*, 25*d* respectively that are spacedly arrayed on second inner surface 23 of flexible body 20 to support flexible body 20 thereover in a hemispherical shape. The positioning of stay envelopes 25*b*, 25*c* carrying the second stay 42 and the third stay 43 respectively accommodates the size of the mesh fabric window 24 so that when the blind is extended to conceal the occupant therein, (FIG. 4), the mesh fabric window 24 is extended fully.

In the preferred embodiment the blind is supported by a known float tube 10, but the blind may also be supported by other structures such as inner tubes, paddle boats, hunting skiffs, and the like. In some instances, such as when field hunting, the blind may also be placed over an opening of a pit, to rest directly on supporting ground surface. In a further embodiment the blind may be supported on plural vertical legs (not shown) that support flexible camouflaged material draping downwardly to the ground so that a occupant may kneel or stand within the blind. If the blind is used to cover the opening of a pit and is placed directly on the ground surface, it may be necessary to anchor the fifth stay 45 to the ground with ground-penetrating tent spikes or the like.

As shown in the Figures, float tube 10 has a general U-shape with a first arm 11, a spacedly adjacent second arm 12 and a back portion 13 extending between the first arm 11 and the second arm 12. A fabric covering 19 which may also have a camouflage pattern extends about the entire surface of the float tube 10 wrapping around the first arm 11, the second arm 12, the back 13 and extending from top 14 to bottom 15 and front 36 to back 13. The fabric covering 19 provides an attachment point for seat 16 that extends across medial space 17 defined by the first arm 11, the second arm 12 and the back 13. The seat 16 provides a resting place for an occupant of the float tube 10 and will support the occupant in a sitting position in water too deep for the occupant to stand in.

In a preferred embodiment, D-ring 18 is connected by known means to the fabric covering 19 of the float tube 10 proximate the top portion 14 of the first arm 11 and the second arm 12 generally medially between front end portion 36 and the back 13. D-rings 18 provide attachment points to positionally secure the frame 40 to the float tube 10. Because distance between the D-ring 18 on the first arm 11 and the D-ring 18 on the second arm 12 is less than the length of the stays 41, 42, 43, 44, 45, the stays 41, 42, 43, 44, 45 must be bent into an arc to interconnect with and extend between the D-ring 18 on the first arm 11 and the D-ring 18 on the second arm 12. The arc of the stays 41, 42, 43, 44, 45 provides the hemispherical shape to the frame 40. In the preferred embodiment, end portion of the pivot axle bolt 47 carrying the pivot axle nut 48 is extended through opening (not shown) defined in the D-ring 18 so that a portion of the D-ring 18 is positioned between inward edge portion of the pivot axle nut 48 and outward edge of end portions of stay 41. In an alternative embodiment, a known type of releasable fastener (not shown) such as, but not limited to, a carabiner may be carried by the frame 40 proximate the pivot axle 47 to releasably interconnect with the D-ring 18.

Attachment strap 50 extends circumferentially around back portion 13 of the float tube 10 to releasably positionally secure rearward circumferential edge of the blind to the float tube 10. The attachment strap 50 extends through a strap loop 51 carried on the body 20 proximate fifth stay 45, and may have a hook and loop type fastener, or similar type of releasable fastener, (not shown), thereon to secure the releasable strap 50 circumferentially about the back portion 13 of the float tube 10.

If D-rings 18 are not provided for on the float tube arms 11, 12 elongate releasable attachment straps 52 may be extended circumferentially about the first arm 11 and about the second arm 12 to carry a D-Ring 18 or other type of fastener (not shown) to releasably engage with the pivot axle bolt 47 to secure the first circumferential edge portion 21*a* and the second circumferential edge portion 21*b* to the first arm 11 and the second arm 12 of the float tube 10 respectively.

Having described the structure of our blind, its operation may be understood.

If a float tube 10 is used as the support, the float tube 10 is inflated as desired. It is preferable that the blind be fastened to the float tube 10 before the float tube 10 is placed in the water.

First end portion 41*a* of first stay 41 is inserted into the medial channel 30 of stay envelope 25*a* proximate forward circumferential edge portion 21 of the first section 31 of the flexible body 20. The first stay 41 should be inserted through the medial channel 30 up to a point where one end portion of the first stay 41 extends outwardly from each end portion of stay envelope 25*a*.

The fifth stay 45 is inserted into stay envelope 25*e* at the circumferential edge portion 21 of the flexible body 20 diametrically opposite the previously installed first stay 41 so that an end portion of the fifth stay 45 extends outwardly from each end of stay envelope 25*e*.

The second stay 42, the third stay 43 and the fourth stay 44 are installed similarly into the medial channels 30 of stay envelopes 25*b*, 25*c*, 25*d* respectively, at the seams (not shown) between the first section 31 and the second section 32, between the second section 32 and the third section 33, and between the third section 33 and the fourth section 34.

First end portions 41*a*, 42*a*, 43*a*, 44*a*, 45*a* of stays 41, 42, 43, 44, 45 are oriented so that pivot axle bolt 47 may be inserted through the axle holes (not shown) defined in the first end portions 41*a*, 42*a*, 43*a*, 44*a*, 45*a*. Pivot axle nut 48 is threadably engaged with the pivot axle bolt 47 to pivotally interconnect the end portions 41*a*, 42*a*, 43*a*, 44*a*, 45*a*.

The stays 41, 42, 43, 44, 45 are simultaneously bent into an arc so that the second end portions (not shown) of the stays 41, 42, 43, 44, 45 are aligned to allow pivot axle bolt 47 to be inserted through the axle holes (not shown) defined in the second end portions (not shown) and secured therein with a pivot axle nut 48. If a washer (not shown) is to be used on the pivot axle bolts 47, the washer (not shown) is installed on the pivot axle bolts 47 before installation of the pivot axle nuts 48. The washer (not shown) increases the security of the interconnection with the D-ring 18.

The frame 40 carrying the flexible body 20 is positioned over the top 14 of the float tube 10 so that the frame 40 and flexible body 20 extend across the medial space 17 defined by the first arm 11, the second arm 12, and the back 13.

End portion of the pivot axle bolt 47 carrying the pivot axle nut 48 is extended through the opening defined in the D-ring 18 carried on the top 14 of float tube arm 11, so that a portion of the D-ring 18 is positioned between the inward edge of pivot axle nut 48 and the outward edge of adjacent end portion of the first stay 41.

The user should move to the opposing edge portion of the float tube 10, grasp the proximate end portions of the stays 41, 42, 43, 44, 45 and push the end portions 41, 42, 43, 44, 45 toward the previously secured end portion so that the stays 41, 42, 43, 44, 45 bend into an arc. The bending of the stays 41, 42, 43, 44, 45 allows the end portions carrying the pivot axle bolt 47 to be manipulated so that the pivot axle bolt 47 and nut 48 thereon may be engaged with the D-ring 18 carried on the second arm 12 of the float tube 10. End portion of the pivot axle bolt 47 carrying the pivot axle nut 48 should extend through the opening defined in the D-ring 18 so that a portion of the D-ring 18 is carried between the inward edge of the pivot axle nut 48 and the adjacent outward edge of the second end portion (not shown) of the first stay 41. Engagement of the two pivot axle bolts 47 with the D-rings 18 secures the diametrically opposed circumferential edge portions 21*a*, 21*b* of the blind to the float tube 10.

Releasable attachment strap 50 is extended circumferentially about the back portion 13 of the float tube 10 and is threaded through strap loop 51 carried by the flexible body 20 proximate medial portion of fifth say 45. End portions (not shown) of the attachment strap 50 are secured together with a hook and loop type fastener or the like (not shown) to secure the rearward circumferential portion 21 of the frame 40 and flexible body 20 to the float tube 10. The securing of the rearward circumferential edge portion 21 to the float tube 10 allows forward circumferential edge portion 21 of the frame 40 and flexible body 20 proximate the front portion 36 of the float tube 10 to be raised and lowered as desired by an occupant sitting on seat 16.

If foliage is to be inserted into the foliage loops 38, "bunches" of grass, cat-tails and the like may secured to the body 20 by inserting the foliage through the foliage loops 38.

In use, a user would launch the blind and sit on the seat 16 extending between the first arm 11 and the second arm 12. The occupant may move to a desired location either by paddling or walking along the bottom. If desired, the occupant may use swim fins or the like to increase maneuverability in the water. If the water is shallow, the user may carry the float tube 10 and attached blind to the desired location.

Once the user reaches the desired location, the user may sit on the seat 16, and extend the flexible body 20 and frame 40 forwardly so that the stays 41, 42, 43, 44, and flexible body 20

"roll" upwardly and forwardly into a hemispherical shape over and about the occupant's upper body. The occupant, while sitting within the blind may visualize the approach of water-fowl and other animals through the mesh fabric window 24. Animals approaching the blind from a direction opposite the mesh fabric window 24 will only visualize the camouflaged 37 first outer surface 22 of the body 20, and are not able to visualize the occupant within the blind because there is no open top, and because the interior of the blind is darker than the exterior, the animal is also not able to visualize the occupant through the mesh fabric window.

When the occupant desires to shoot at or photograph the sought after animal, the occupant reaches forwardly and grasps the bottom edge of the first stay 41 at the forward circumferential edge portion 21 of the flexible body 20. With a lifting motion the occupant can "flip" the frame 40 and flexible body 20 upwardly and rearwardly to retract the blind which allows the hunter to discharge his weapon at or photograph the sought after animal.

When the user desires to conceal himself again, the user reaches rearwardly and grasps the circumferential edge portion 21 of the flexible body 20 and the frame 40, preferably at about the first stay 41, and pulls the frame 40 and flexible body 20 forwardly and upwardly causing the frame stays 41, 42, 43, 44, 45 to pivot about the pivot axles 47 and extend forwardly into a hemispherical shape that conceals the occupant.

Having thusly described the structure and operation of our sportsman's blind what we claim is:

1. A pivotally retractable sportsman's blind for releasable attachment to an inflatable float tube having a "U" shape comprising in combination:

a flexible fabric body having an inner surface and outer surface and a circumferential edge extending thereabout and plural spacedly arrayed stay envelopes on the inner surface extending from a first circumferential edge portion to a second circumferential edge portion;

a frame of plural resiliently deformable single piece stays of the same length, each stay carried in a stay envelope to flex into an arc and extend the flexible body into a hemispherical shape, each stay having opposing end portions, each end portion of each stay defining a pivot axle hole;

a pivot axle simultaneously carried in the pivot axle holes of proximate end portions of each stay to maintain the stay end portions in pivotal relationship with one another to allow each stay to pivot independently of the other stays to allow the frame and flexible body to pivot from a first extended position to a second retracted position;

a "U" shaped float tube having a first arm, a spaced apart second arm and a back portion communicating between the first arm and the second arm at proximate end portions of the arms, and a fabric covering extending about the entire float tube;

an attachment means for releasably fastening the frame and flexible body to upper portions of the first and second arms of the inflatable "U" shaped float tube; and a flexible window carried by the flexible body to allow an occupant within the blind to see outwardly from within the blind through the flexible window.

2. The sportsman's blind of claim 1 wherein:

the flexible window is formed of mesh-type fabric.

3. The sportsman's blind of claim 1 wherein:

the flexible body is opaque and camouflaged.

4. The sportsman's blind of claim 1 wherein:

the frame is manually pivoted by the occupant from the first extended position having a configuration defining a hemispherical half sphere covering the float tube and an occupant of the float tube to the second retracted position exposing the float tube and the occupant of the float tube and from the second retracted position to the first extended position.

5. The sportsman's blind of claim 1 wherein:

the flexible body is formed of plural sector shaped pieces of fabric fastened together at adjacent edge portions.

6. The sportsman's blind of claim 1 further comprising:

plural foliage fasteners spacedly arrayed about the flexible body to releasably fasten foliage to the flexible body.

7. The sportsman's blind of claim 1 wherein:

the flexible window is formed of porthole mesh.

8. The sportsman's blind of claim 1 wherein:

the flexible window is formed of mosquito netting.

9. The sportsman's blind of claim 1 wherein:

the hemisphere shape of the frame and flexible body when in a first extended position is a half sphere.

* * * * *